US009205028B2

(12) United States Patent
Marseglia

(10) Patent No.: US 9,205,028 B2
(45) Date of Patent: Dec. 8, 2015

(54) APPARATUS FOR STORING AND DISPENSING BABY BOTTLE NIPPLES AND COLLARS

(71) Applicant: Eric Peter Marseglia, Hermosa Beach, CA (US)

(72) Inventor: Eric Peter Marseglia, Hermosa Beach, CA (US)

( * ) Notice: Subject to any disclaimer, the term of this patent is extended or adjusted under 35 U.S.C. 154(b) by 138 days.

(21) Appl. No.: 14/046,689

(22) Filed: Oct. 4, 2013

(65) Prior Publication Data

US 2015/0096916 A1 Apr. 9, 2015

(51) Int. Cl.
*A61J 11/00* (2006.01)

(52) U.S. Cl.
CPC ..... *A61J 11/0075* (2013.01); *A61J 11/00* (2013.01)

(58) Field of Classification Search
CPC combination set(s) only.
See application file for complete search history.

(56) References Cited

U.S. PATENT DOCUMENTS

| | | | | |
|---|---|---|---|---|
| 5,688,238 | A * | 11/1997 | Moser et al. | 604/77 |
| 8,210,350 | B1 * | 7/2012 | Marseglia | 206/445 |
| 8,671,491 | B1 * | 3/2014 | Pijor et al. | 15/21.1 |
| 2014/0238949 | A1 * | 8/2014 | Patel | 215/6 |
| 2015/0069005 | A1 * | 3/2015 | Diaz | 215/11.5 |

* cited by examiner

*Primary Examiner* — Jacob K Ackun
(74) *Attorney, Agent, or Firm* — PLAGER SCHACK LLP

(57) ABSTRACT

An apparatus for storing both clean and used baby bottle nipples and collars includes a transparent cylindrical tubular member with a first open end and a second open end, a first nipple-shaped cap pivotably mounted to the first open end, a second cap pivotably mounted to the second open end, and a flexible insert with a nipple-shaped member having a concave side wall affixed to the bottom of the nipple-shaped member, the concave side wall having a top portion and a bottom portion both slidably in contact with the interior of the cylindrical tubular member, the top and bottom portions of the concave side wall able to provide a seal between the side wall and the cylindrical tubular member that prevents a cross-contamination between the clean bottle nipples and collars stored above the flexible insert and the used bottle nipples and collars stored below the insert.

6 Claims, 4 Drawing Sheets

APPARATUS FOR STORING AND DISPENSING BABY BOTTLE NIPPLES AND COLLARS

BACKGROUND

The embodiments herein relate generally to an apparatus for storing and dispensing baby bottle nipples and collars.

Parents have to feed their infants or toddlers multiple times throughout the day and/or night. Baby bottle nipples and collars need to be washed and sanitized before each use. When traveling, it is advantageous for parents to carry multiple clean bottle nipples and collars because it is not always convenient to clean them before each successive use. A baby bottle nipple and collar storage and dispenser case is disclosed in U.S. Pat. No. 8,210,350, which is a device comprising a cylindrical tubular member comprising a first open end and a second open end, first and second caps affixed to the open ends of the tubular member, and a divider insert placed within the cylindrical tubular member to separate the clean nipples and collars from the used nipples and collars. However, this device is limited because the divider insert is not water resistant and/or waterproof. Further, the insert is not designed to prevent a cross-contamination between the clean nipples and collars stored above the insert and the used nipples and collars stored below the insert. Another limitation is the first and second caps are each engaged with an open end of the cylindrical tubular member by a threaded ring that is tethered to the cap. However, this threaded ring is costly to manufacture and is not durable because the threads are especially vulnerable to premature wear and tear. This may render the threaded rings ineffective or unusable, thereby affecting the use, longevity and structural integrity of the caps.

As such, there is a need in the industry for an apparatus for storing and dispensing baby bottle nipples and collars that has a water resistant/water proof insert that effectively prevents a cross-contamination between the stored clean and dirty nipples and collars. There is a further need in the industry for an apparatus for storing and dispensing baby bottle nipples and collars that is durable and structurally sound.

SUMMARY

An apparatus for storing both clean and used baby bottle nipples and collars is provided. The apparatus is configured to separate the stored clean bottle nipples and collars from the stored used bottle nipples and collars. The apparatus comprises a transparent cylindrical tubular member comprising a first open end and a second open end, a first nipple-shaped cap pivotably mounted to the first open end of the cylindrical tubular member, a second cap pivotably mounted to the second open end of the cylindrical tubular member, and a flexible insert comprising a nipple-shaped member comprising a concave side wall affixed to the bottom of the nipple-shaped member, the concave side wall comprising a top portion and a bottom portion both slidably in contact with the interior of the cylindrical tubular member such that the surface area of the side wall in contact with the cylindrical tubular member is minimized to reduce friction, the top portion and the bottom portion of the concave side wall configured to provide a seal between the concave side wall and the cylindrical tubular member that prevents a cross-contamination between the clean bottle nipples and collars stored above the flexible insert and the used bottle nipples and collars stored below the insert.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
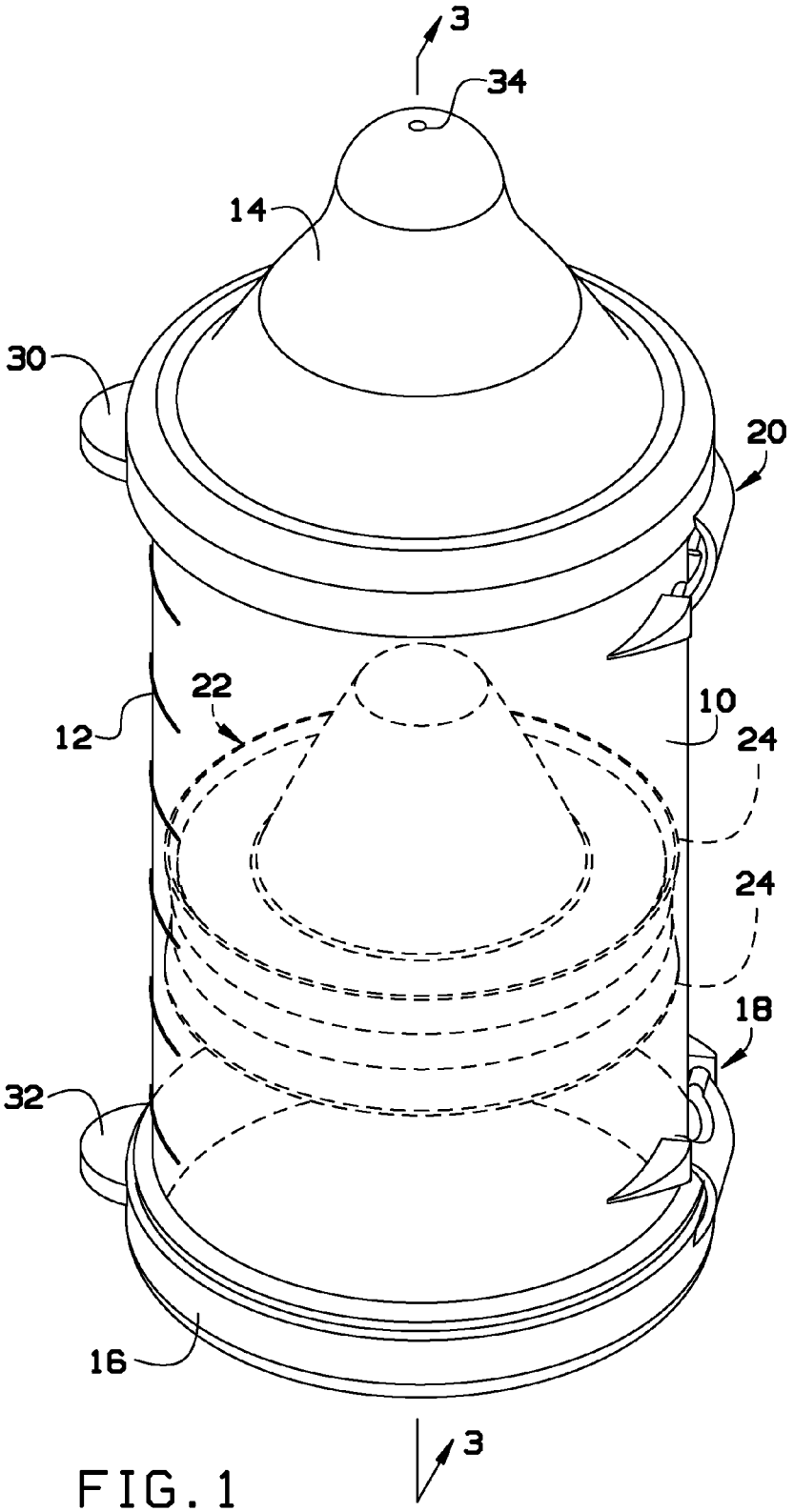
FIG. 1 depicts a perspective view of one embodiment of the invention.
Figure 2:
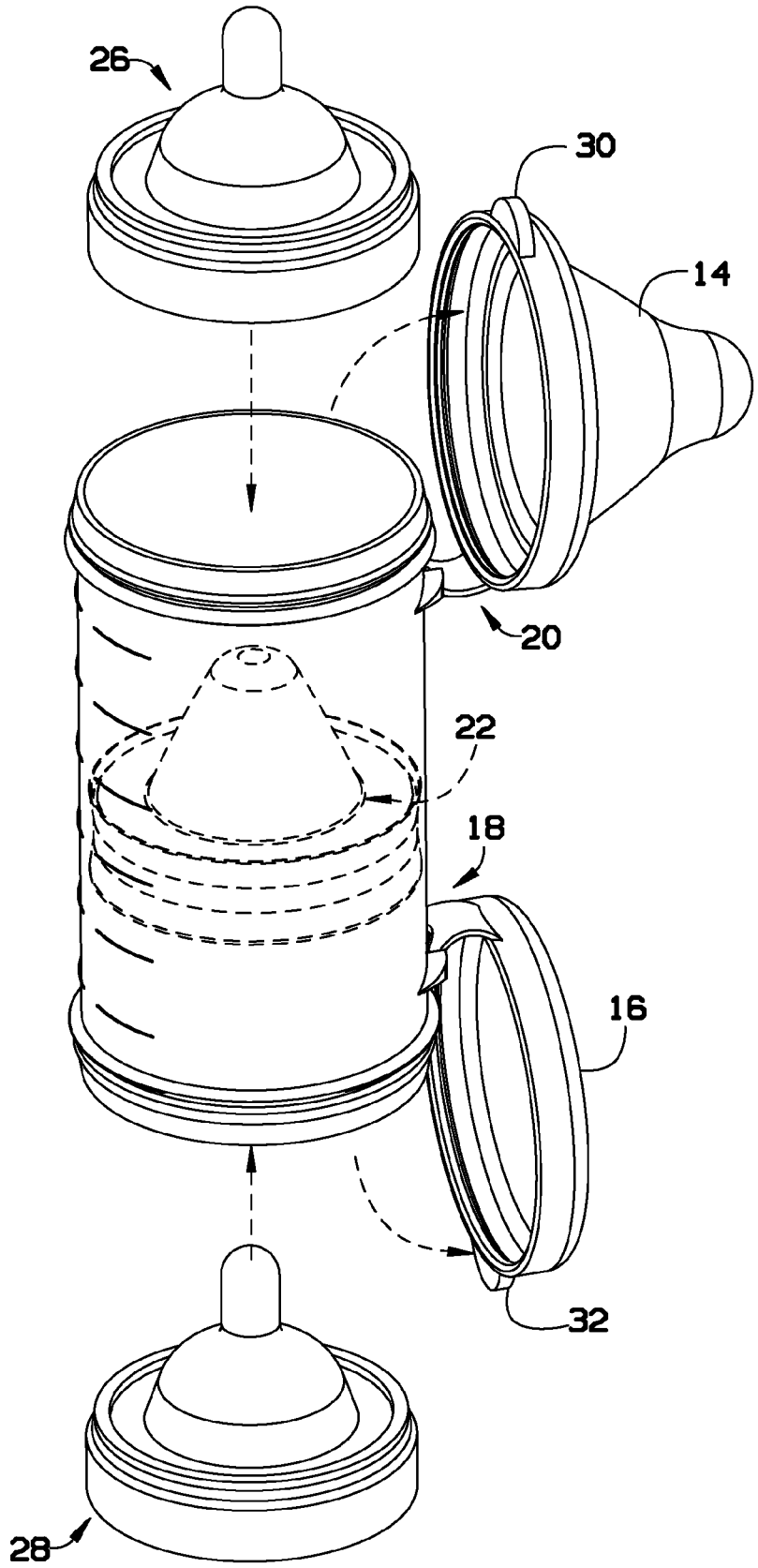
FIG. 2 depicts an exploded view of one embodiment of the invention demonstrating the insertion of an exemplary nipple and collar.
Figure 3:
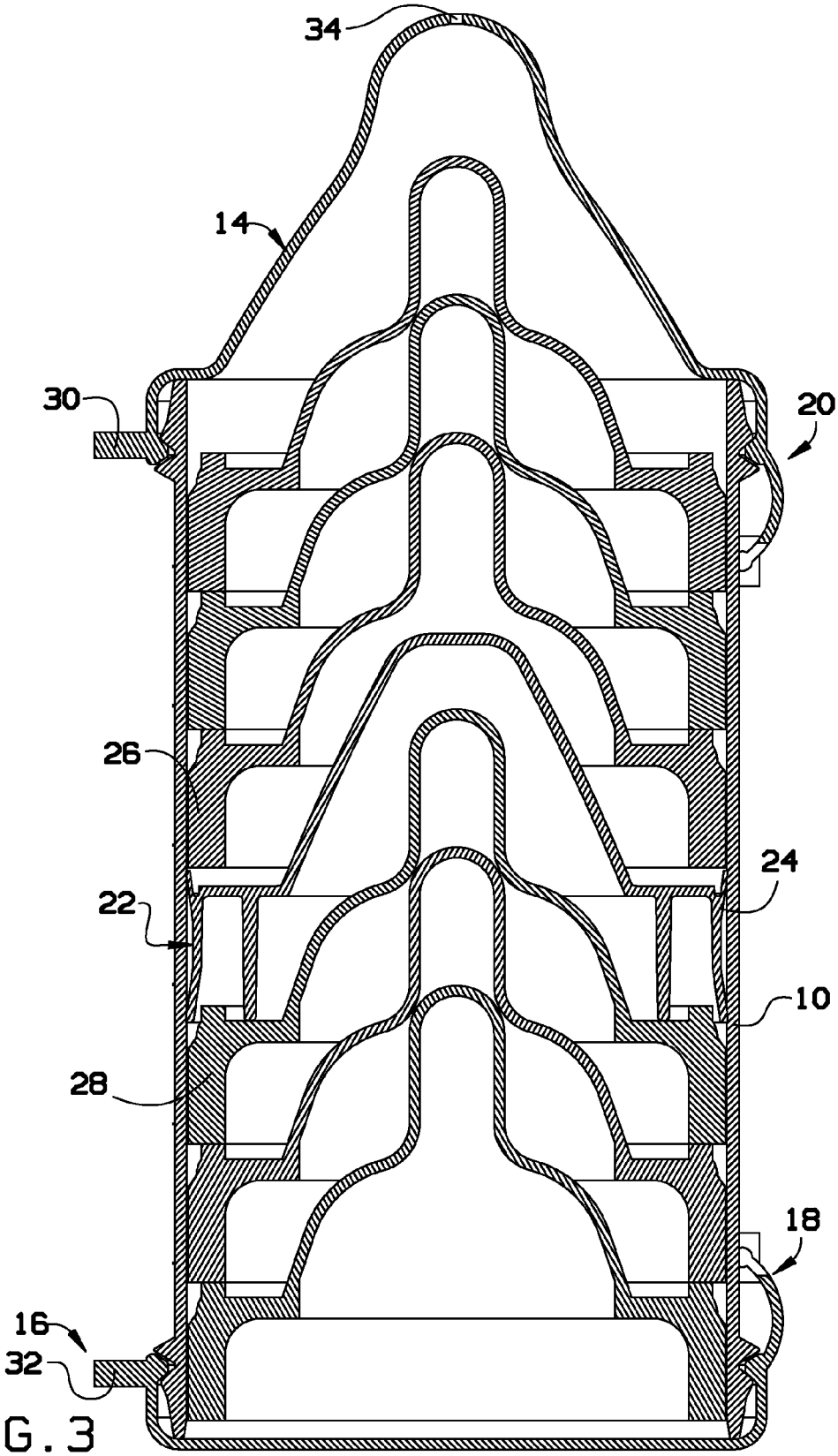
FIG. 3 depicts a sectional view of one embodiment of the invention taken along line 3-3 in FIG. 1.

FIGS. 1-3 depict certain embodiments of the apparatus for storing and dispensing baby bottle nipples and collars. The apparatus comprises transparent cylindrical tubular member 10, inventory level chart 12, top nipple-shaped cap 14, top cap tab 30, top cap aperture 34, top cap hinge 20, bottom cap 16, bottom cap tab 32 and bottom cap hinge 18. Top cap hinge 20 and bottom cap hinge 18 allow top nipple-shaped cap 14 and bottom cap 16 to snap directly into indentations of the wall of cylindrical tubular member 10 to a locked position. As shown in FIG. 3, top nipple-shaped cap 14 is connected to top cap hinge 20 by a curved tab. Likewise, bottom cap 16 is connected to bottom cap hinge 18 by a curved tab. Tabs 30 and 32 allow a user to easily engage or disengage top nipple-shaped cap 14 or bottom cap 16 from cylindrical tubular member 10. Inventory level chart 12 provides markings on the side of cylindrical tubular member 10 to allow a user to visually determine the number of clean and/or used nipples and collars stored within the apparatus.

The apparatus further comprises water resistant separator insert 22, which comprises a concave side wall having seals 24. Seals 24 comprise a top portion and a bottom portion of the concave side wall, which are both configured to be slidably in contact with the interior wall of cylindrical tubular member 10.

As depicted in FIG. 2, the apparatus is configured to store clean nipple and collar 26 and used nipple and collar 28. Clean nipple and collar 26 is placed within cylindrical tubular member 10 and above water resistant separator insert 22. Used nipple and collar 28 is placed within cylindrical tubular member 10 and below water resistant separator insert 22. As such, water resistant separator insert 22 provides a barrier between clean nipple and collar 26 and used nipple and collar 28. As depicted in FIG. 3, cylindrical tubular member 10 may store a plurality of clean nipple and collars 26 and a plurality of used nipple and collars 28. A user may remove a clean nipple and collar 26 from the top of cylindrical tubular member 10 to be used to feed a baby. Once the nipple and collar is used, the user may slide the remaining stored clean nipple and collars 26, water resistant separator insert 22 and the stored used nipple and collars 28 upward within cylindrical tubular member 10 to make room for the insertion of the used nipple and collar 28 through the bottom of tubular member 10. If top nipple-shaped cap 14 is engaged and locked into place with cylindrical tubular member 10, top cap aperture 34 serves as an air release vent that allows air trapped within the tubular member to be released when clean nipples and collars 26, water resistant separator insert 22 and used nipples and collars 28 are pushed upwards through cylindrical tubular member 10. It shall be appreciated that top cap aperture 34 also provides additional ventilation within cylindrical tubular member 10 to prevent any moisture build-up that may cause the growth of bacteria and/or mold within the apparatus.

Figure 4:
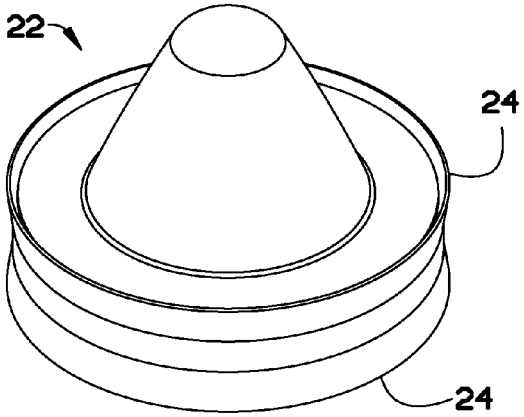
FIG. 4 depicts a top perspective view of one embodiment of the invention illustrating the flexible insert.

FIG. 4 depicts a top perspective view of water resistant separator insert 22. The triangular shape on the top of the insert allows nipples and collars to rest on top of the insert. The flexible concave side wall of insert 22 create a top portion and a bottom portion of the side wall that presses against and remains in contact with the interior of cylindrical tubular member 10. It shall be appreciated that the concave shape of the side wall minimizes the surface area of insert 22 in contact with cylindrical tubular member 10, thereby reducing the friction between the components and allowing insert 22 to easily slide within tubular member 10. The top portion and bottom portion of the side wall provide a seal between the side wall and the cylindrical tubular member 10 that prevents a cross-contamination between clean bottle nipples and collars 26 stored above insert 22 and used bottle nipples and collars 28 stored below insert 22.

Figure 5:
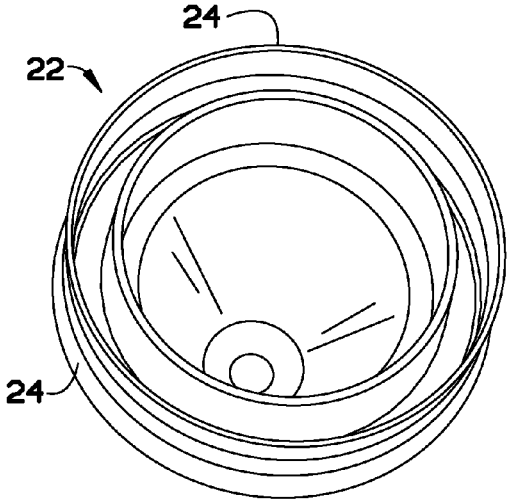
FIG. 5 depicts a bottom perspective view of one embodiment of the invention illustrating the flexible insert.

FIG. 5 depicts a bottom perspective view of water resistant separator insert 22. The bottom of insert 22 comprises a hollow portion and a thin interior round wall support. This design allows nipples and collars to rest directly below insert 22.

Figure 6:
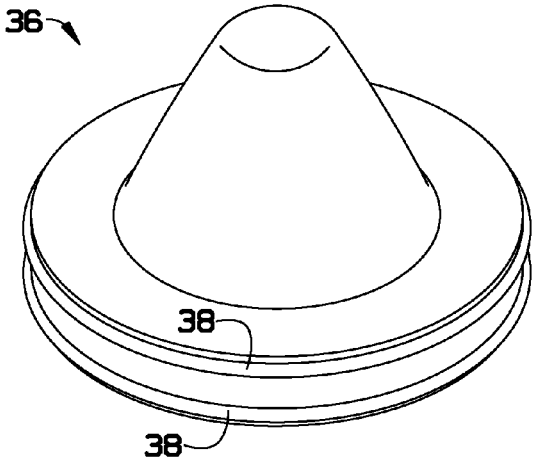
FIG. 6 depicts a top perspective view of an alternate embodiment of the invention illustrating the flexible insert.
Figure 7:
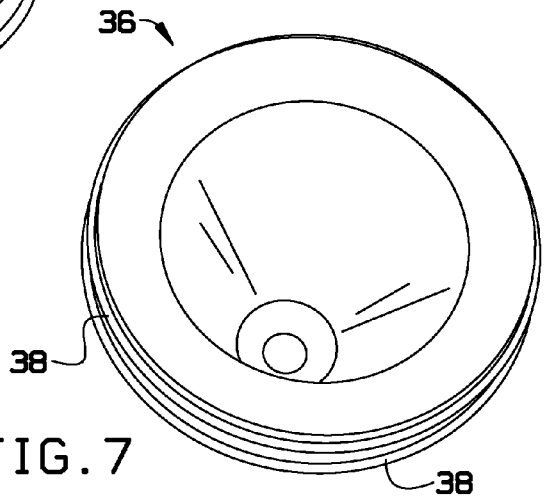
FIG. 7 depicts a bottom perspective view of an alternate embodiment of the invention illustrating the flexible insert.

FIG. 6 depicts a top perspective view of waterproof separator insert 36 used in an alternative embodiment of the invention. Like water resistant insert 22, waterproof insert 36 has a triangular shape on the top to allow nipples and collars to rest on top of the insert. The side wall of waterproof insert 36 comprises two grooves wherein each groove is configured to receive a silicone o-ring 38, which can expand and contract within cylindrical tubular member 10. The silicone o-rings 38 provide a waterproof seal between the side wall of insert 36 and the cylindrical tubular member 10 that prevents a cross-contamination between clean bottle nipples and collars 26 stored above insert 36 and used bottle nipples and collars 28 stored below insert 36. It shall be appreciated that waterproof separator insert 36 can easily slide within the interior of cylindrical tubular member 10. FIG. 7 depicts a bottom perspective view of waterproof separator insert 36. The bottom of insert 36 comprises a hollow portion to allow nipples and collars to rest directly below the insert.

The components of the apparatus described herein are manufactured using any known equipment and techniques in the field such as a mold-injected process using polypropylene. A machine inserts the polypropylene into a mold to form each component. The components can subsequently be assembled by machine or by hand.

In operation, a user may store both clean and used nipples and collars within cylindrical tubular member 10 such that the clean nipples and collars are separated from the used nipples and collars by insert 22 or insert 36. A user removes the used nipple and collar from a feeding bottle (not shown), opens the apparatus by opening bottom cap 16 by applying a force to bottom cap tab 32. The user may slide the remaining stored clean nipple and collars 26, water resistant separator insert 22 and the stored used nipple and collars 28 upward within cylindrical tubular member 10 to make room for the insertion of the used nipple and collar 28 through the bottom of tubular member 10. The user snaps bottom cap 16 back into cylindrical tubular member 10 to the locked position for proper storage of the nipples and collars. At any time, the user may open nipple-shaped cap 14 by applying a force to top cap tab 30 to remove a clean nipple and collar 26 from cylindrical tubular member 10. After the clean nipple and collar 26 is used on a feeding bottle, the nipple and collar may be inserted into the bottom of tubular member 10 as described above. At any time, the user can visually determine the number of clean nipples and collars or used nipple and collars stored within cylindrical tubular member 10 by glancing at inventory level chart 12, which comprises consecutive numeric markings, e.g., 1, 2, 3, etc. In a preferred embodiment, cylindrical tubular member 10 has a pair of inventory level charts 12 on different portions of cylindrical tubular member 10. A first inventory level chart 12 is designated to provide an inventory count of the stored clean nipples and collars 26. A second inventory level chart 12 is designated to provide an inventory count of the stored used nipples and collars 28.

It shall be appreciated that the components of the apparatus described in several embodiments herein may comprise any known materials in the field and be of any color, size and/or dimensions. This allows the apparatus to accommodate any variety and number of bottle nipples and collars.

Persons of ordinary skill in the art may appreciate that numerous design configurations may be possible to enjoy the functional benefits of the inventive apparatus. Thus, given the wide variety of configurations and arrangements of embodiments of the present invention the scope of the invention is reflected by the breadth of the claims below rather than narrowed by the embodiments described above.

What is claimed is:

1. An apparatus for storing both clean and used baby bottle nipples and collars, the apparatus configured to separate the stored clean bottle nipples and collars from the stored used bottle nipples and collars, the apparatus comprising:

a transparent cylindrical tubular member comprising a first open end and a second open end;

a first nipple-shaped cap pivotably mounted to the first open end of the cylindrical tubular member;

a second cap pivotably mounted to the second open end of the cylindrical tubular member; and a flexible insert comprising a nipple-shaped member comprising a concave side wall affixed to the bottom of the nipple-shaped member, the concave side wall comprising a top portion and a bottom portion both slidably in contact with the interior of the cylindrical tubular member such that the surface area of the side wall in contact with the cylindrical tubular member is minimized to reduce friction, the top portion and the bottom portion of the concave side wall configured to provide a seal between the concave side wall and the cylindrical tubular member that prevents a cross-contamination between the clean bottle nipples and collars stored above the flexible insert and the used bottle nipples and collars stored below the insert.

2. The apparatus of claim 1, wherein the first and second caps are each pivotably mounted to the cylindrical tubular member by a hinge, wherein the hinge enhances the structural integrity of the caps.

3. The apparatus of claim 2, wherein the top portion of the side wall comprises a first groove and the bottom portion of the side wall comprises a second groove, wherein each groove is configured to receive an o-ring.

4. The apparatus of claim 2, wherein the first nipple-shaped cap comprises an aperture configured to release air stored within the cylindrical tubular member.

5. The apparatus of claim 2 further comprising numeric markings affixed to the cylindrical tubular member, the numeric markings configured to enable a user to visually determine the number of clean and used bottle nipples and collars stored within the cylindrical tubular member.

6. The apparatus of claim 2 further comprising a first tab affixed to the outer portion of the first nipple-shaped cap and a second tab affixed to the outer portion of the second cap.

* * * * *